US011486233B2

(12) United States Patent
Sadler et al.

(10) Patent No.: US 11,486,233 B2
(45) Date of Patent: Nov. 1, 2022

(54) SYMPATHETICALLY DETONATED SELF-CENTERING EXPLOSIVE DEVICE

(71) Applicant: Raytheon Company, Waltham, MA (US)

(72) Inventors: Coulton Sadler, Tucson, AZ (US); Mitchell Moffet, Tucson, AZ (US); Henri Y. Kim, Tucson, AZ (US)

(73) Assignee: RAYTHEON COMPANY, Waltham, MA (US)

( * ) Notice: Subject to any disclaimer, the term of this patent is extended or adjusted under 35 U.S.C. 154(b) by 156 days.

(21) Appl. No.: 16/951,266

(22) Filed: Nov. 18, 2020

(65) Prior Publication Data

US 2022/0154559 A1 May 19, 2022

(51) Int. Cl.

| | |
|---|---|
| ***E21B 43/117*** | (2006.01) |
| ***F42D 1/02*** | (2006.01) |
| ***F42B 1/028*** | (2006.01) |

(52) U.S. Cl.

CPC ..... *E21B 43/117* (2013.01); *F42B 1/028* (2013.01); *F42D 1/02* (2013.01)

(58) Field of Classification Search

CPC ..... E21B 43/11; E21B 43/116; E21B 43/117; E21B 43/118; F42D 1/02; F42B 1/028

See application file for complete search history.

(56) References Cited

U.S. PATENT DOCUMENTS

| | | | |
|---|---|---|---|
| 2,766,690 A | 10/1956 | Lebourg | |
| 4,109,576 A | 8/1978 | Eckels | |
| 4,612,859 A | 9/1986 | Furch et al. | |
| 6,026,750 A | 2/2000 | Nelson | |
| 8,191,479 B2 * | 6/2012 | Ruhlman | F42B 1/028 102/265 |
| 8,464,639 B2 * | 6/2013 | Thomas | F42C 19/095 102/275.9 |
| 9,383,176 B2 | 7/2016 | Arguello et al. | |

(Continued)

FOREIGN PATENT DOCUMENTS

| | | |
|---|---|---|
| WO | 2015171150 A1 | 11/2015 |
| WO | 2018160315 A1 | 9/2018 |
| WO | 2019148009 A2 | 8/2019 |

OTHER PUBLICATIONS

International Search Report and Written Opinion dated May 10, 2022 for PCT/US2021/047435.

*Primary Examiner* — Yong-Suk (Philip) Ro

(74) *Attorney, Agent, or Firm* — Bachman & LaPointe, P.C.

(57) ABSTRACT

An explosive device includes a housing having an outer surface and defining an inner space; a plurality of primary liners arranged on the outer surface in a spaced pattern and having primary energetic material inwardly positioned in the housing relative to the primary liners; an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material. The device can find useful application in a military setting and also in the perforation of well casings in subterranean wells.

19 Claims, 4 Drawing Sheets

(56) References Cited

U.S. PATENT DOCUMENTS

| | | | | |
|---|---|---|---|---|
| 9,995,562 | B2 | 6/2018 | Jennett et al. | |
| 10,151,180 | B2 * | 12/2018 | Robey | E21B 43/117 |
| 11,346,191 | B2 * | 5/2022 | Sokolove | E21B 43/116 |
| 2013/0112411 | A1 | 5/2013 | Shi et al. | |
| 2013/0118805 | A1 * | 5/2013 | Moody-Stuart | E21B 43/116 175/2 |
| 2017/0328134 | A1 * | 11/2017 | Sampson | E21B 7/1245 |
| 2018/0030334 | A1 | 2/2018 | Collier et al. | |
| 2020/0072029 | A1 | 3/2020 | Anthony et al. | |

* cited by examiner

SYMPATHETICALLY DETONATED SELF-CENTERING EXPLOSIVE DEVICE

BACKGROUND OF THE DISCLOSURE

The disclosure relates to design of an explosive device and, more particularly, to an explosive device having primary and sympathetically initiated subassemblies.

Explosive devices have wide application. In military ordnance, explosive or destructive devices commonly referred to simply as warheads have been developed to accomplish a wide variety of military mission requirements.

A shaped charge warhead generally has a conical liner that projects a hypervelocity jet of metal or other liner material able to penetrate steel armor to great depths. Generally, such a warhead includes an axially symmetric combination of components including, among others, a liner designed to collapse upon explosive detonation and form a directed-energy penetrator, an explosive material or charge, a firing or explosive initiation mechanism intended to detonate the explosive charge and thereby forcibly propel the penetrator toward a target, and a warhead housing in which the liner and explosive charge are confined before firing.

A similar warhead is an explosively formed penetrator (EFP). An EFP typically has a liner face in the shape of a shallow dish. The force of the blast molds the liner into any of a number of shapes, depending on the shape of the plate and how the explosive is detonated. Some EFP warheads have multiple detonators that can be fired in different arrangements causing different types of waveform in the explosive, resulting in either a long-rod penetrator, an aerodynamic slug projectile, or multiple high-velocity fragments.

Some EFP warheads have liners designed to produce more than one penetrator; these are known as multiple EFPs, or MEFPs. The liner of an MEFP generally comprises a number of liners. Upon detonation, the liners form a number of projectiles. The pattern of projectile trajectory and impact on one or more targets can be controlled based on the design of the liner and the manner in which the explosive charge is detonated.

Another similar warhead is one that relies upon a shaped charge jet, or SCJ, and similar concerns are present with SCJ. In such warheads, a shaped charge jet is formed by a liner upon initiation of an associated explosive charge, and the pattern of SCJ trajectory and impact on one or more targets can also be controlled based on the design of the liner and the manner in which the explosive charge is detonated.

Detonation of the explosive charge, or initiation, is typically accomplished with a complex precision initiation coupler (PIC). In one configuration, a warhead can have a generally cylindrical shape, with liners arranged around the cylindrical surface of a cylindrical housing. The PIC mechanism(s) are located in a central area of the housing, and are a source of manufacturing complexity. It is also an important consideration to have initiation of multiple liners be as close to simultaneous as possible.

Design of a PIC mechanism to meet these requirements results in a sensitive and space-consuming mechanisms resulting in a limitation on design when using, for example, a cylindrical housing. In such a warhead design, the PIC mechanism is located in the center of the cylindrical housing, along the centerline of a given liner, where space is limited, resulting in the ability to include fewer forming liners than might otherwise be desired. This results in warhead designs having less than desired target lethality.

SUMMARY OF THE DISCLOSURE

The disclosure relates to an explosive device having primary and additional subassemblies that can be initiated by initiating energetic material of the primary subassemblies. This leads to self-centering sympathetic initiation of the additional subassemblies.

In one non-limiting configuration the disclosure relates to an explosive device comprising: a housing having an outer surface and defining an inner space; a plurality of primary liners arranged on the outer surface in a spaced pattern and having primary energetic material inwardly positioned in the housing relative to the primary liners; an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material.

In another non-limiting configuration the housing is a cylindrical housing and the outer surface is an outwardly facing cylindrical surface of the cylindrical housing.

In a further non-limiting configuration each additional liner is positioned between at least 2 primary liners, the at least 2 primary liners being positioned around the each additional liner.

In still another non-limiting configuration, each additional liner is positioned between 4 symmetrically positioned primary liners.

In a still further non-limiting configuration the additional energetic material of the additional liners extends inwardly in a stem positioned between the primary energetic material such that initiation of the primary energetic material forms a pressure wave that initiates the additional energetic material.

In another non-limiting configuration the stem has a diameter that is between 150% and 200% of the critical diameter of the stem.

In a further non-limiting configuration the stem has a ratio of length to critical diameter of the stem of at least 3:1.

In still another non-limiting configuration each primary liner of the plurality of primary liners has an outwardly convex shape, and the primary energetic material surrounds an inner surface of the primary liner.

In a still further non-limiting configuration, each additional liner of the plurality of additional liners has an outwardly convex shape, and the additional energetic material surrounds an inner surface of the additional liner.

In another non-limiting configuration the plurality of primary liners and the plurality of additional liners comprise metallic liners, ceramic liners and combinations thereof.

In a further non-limiting configuration the liners comprise at least one material selected from the group consisting of copper, tantalum, aluminum, steel, ceramic, molybdenum, glass, and mixtures, combinations, composites or alloys thereof.

In still another non-limiting configuration the energetic material comprises a polymer-bonded explosive.

In a still further non-limiting configuration the housing has a plurality of openings, and the primary liners and the additional liners are mounted in the openings.

In another non-limiting configuration the housing comprises a material selected from the group consisting of aluminum, steel, titanium and combinations or alloys thereof.

In a further non-limiting configuration the primary liners cover between 50% and 80% of the outer surface, and the additional liners cover between 20% and 50% of the outer surface.

In still another non-limiting configuration the additional energetic material is positioned to be initiated only by initiation of the primary energetic material.

In a still further non-limiting configuration the additional energetic material is positioned to be initiated only by pressure waves caused by initiation of the primary energetic material.

In another non-limiting configuration the primary energetic material and the additional energetic material are configured within the housing such that initiation of the primary energetic material generates particles traveling at between 1 and 10 km/s.

In a further non-limiting configuration, a method is disclosed for perforating a side wall of a subterranean well, the method comprising the steps of positioning an explosive device through a subterranean well defined be a well casing to a desired position in the well casing, wherein the explosive device comprises a housing having an outer surface and defining an inner space; a plurality of primary liners arranged on the outer surface in a spaced pattern and having primary energetic material inwardly positioned in the housing relative to the primary liners; an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material; and initiating the primary energetic material wherein the additional energetic material is sympathetically initiated by the primary energetic material, and the primary liners and additional liners perforate the side wall.

BRIEF DESCRIPTION OF THE DRAWINGS

A detailed description of one or more embodiments of the disclosure follows, with reference to the attached drawings, wherein.

Like reference numbers and designations in the various drawings indicate like elements.

DETAILED DESCRIPTION

The present disclosure relates to an explosive device and, more particularly, to a forming projectile such as a shaped charge or formed projectile device. Such a device can be useful in a military setting, and also for generating perforations in well casings of subterranean wells. The device has multiple active subassemblies or liners, some of which are initiated sympathetically. This leads to greater penetration performance, for example in the form of more penetration instances, and in a military setting, increased lethal density.

Figure 1:
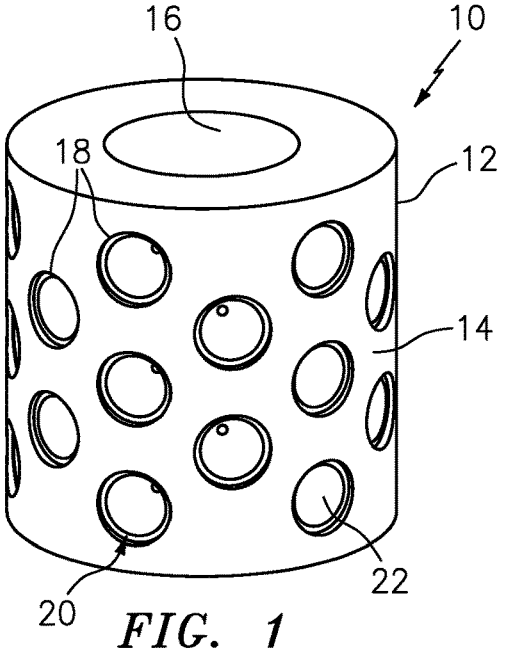
FIG. 1 schematically illustrates an explosive device in the form of a cylindrical formed warhead having a plurality of liners or subassemblies.

FIG. 1 shows a portion of an explosive device 10 having a cylindrical housing 12. The cylindrical housing 12 defines an outer surface 14, and an inner space 16. The outer surface 14 has a plurality of openings 18, and a formed charge subassembly 20 is mounted in each opening 18. Formed charge subassemblies 20 are initiated when desired through a precision initiation coupler (PIC) device which is not further illustrated in FIG. 1. Subassemblies 20 have a liner 22 which is shown in FIG. 1 as a conically shaped member mounted in each opening 18. When device 10 is initiated, energetic material behind each liner 22 drives liner 22 outwardly, generating a stream of plastically deforming liner material at speeds up to 11 km/s, typically between 1 and 10 km/s, and can in one non-limiting configuration be between 2 and 9 km/s.

It can be appreciated from FIG. 1 that an appreciable amount of outer surface 14 is open spaced that is not otherwise utilized. One of the main reasons for this is that the PIC device takes up significant space at the center of explosive device 10, and therefore only a limited number of subassemblies 20 can be positioned on outer surface 14. On the other hand, it is generally necessary to have PIC devices to initiate the subassemblies as these subassemblies must be initiated substantially simultaneously, generally within microseconds of each other, to preserve balance during initiation and maintain optimal velocity from each subassembly.

Figure 2:
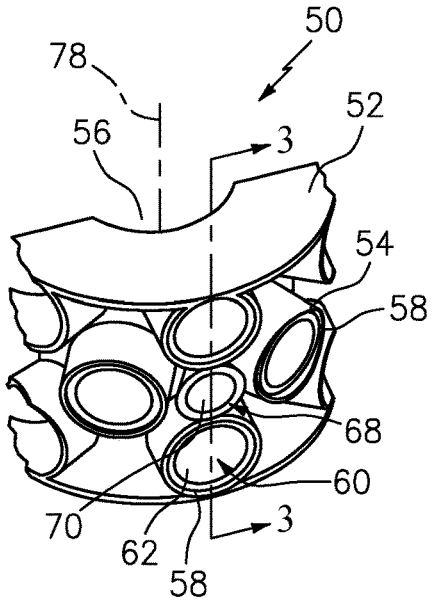
FIG. 2 illustrates a non-limiting configuration of a cylindrical formed warhead having primary liners and additional liners arranged for sympathetic initiation by the primary liner initiation.

Turning to FIG. 2, a non-limiting illustration of a device 50 according to this disclosure is shown, again in the form of a generally cylindrical housing 52 having an outer surface 54 and defining an inner space 56. Outer surface 54 has a plurality of primary openings 58, with a plurality of primary subassemblies 60 mounted therein. As with the configuration of FIG. 1, these primary subassemblies include a primary liner 62 which is backed by primary energetic material 64 (See also FIG. 3), and PIC 66 to initiate primary energetic material 64. Additional openings 68 are also positioned in outer surface 54, and additional subassemblies 70 are mounted in additional openings 68. Additional subassemblies 70 have an additional liner 72, and additional energetic material 74. However, there is no PIC arranged to initiate additional energetic material 74. Rather, additional subassemblies 70 are initiated sympathetically by initiation of primary subassemblies 60.

Sympathetic initiation of additional subassemblies 70 needs also to be substantially simultaneous, and also is desirably centered along an intended trajectory from each subassembly (broken line 76, FIG. 3), and also overall relative to a central axis (broken line 78, FIG. 2) of housing 52. In order to accomplish this balance, each additional subassembly 70 is positioned between adjacent primary subassemblies, advantageously between at least two primary subassemblies, and further advantageously between 4 symmetrically arranged primary subassemblies as shown in FIG. 2. Of course, different arrangements are possible depending upon shape of the housing and other design considerations, and could result in symmetrical patterns of 3 or 5 or other number of primary subassemblies positioned in a spaced pattern in the housing, around the additional subassemblies. Further, in some instances a non-symmetrical arrangement may be desired. In such cases, a self-centering initiation can still be obtained by configuring housing, energetic material and liners appropriately. Of course, this adds design complexity, symmetrical configurations are therefore particularly useful within the scope of this disclosure.

Figure 3:
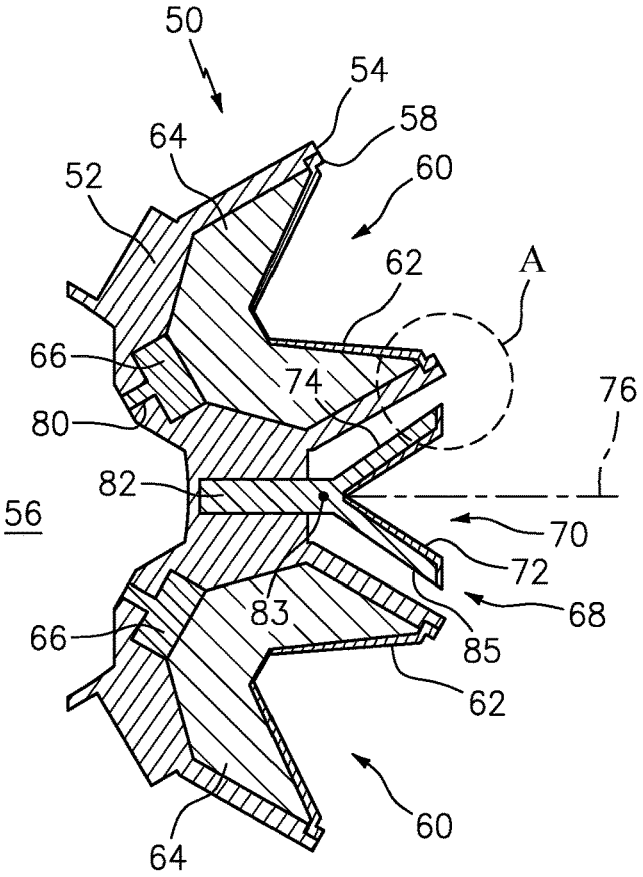
FIG. 3 is a cross section taken along the lines 3-3 of FIG. 2.

FIG. 3 shows an internal geometry of housing 52 and energetic material 64, 74, which is configured such that pressure waves generated by initiation of energetic material 64 encounter additional energetic material 74 in such a manner that the additional energetic material is initiated and centered along axis 76 as desired. As shown, primary openings 58 can be outwardly opening cup shaped receptacles having an inner central opening 80 to allow mounting and operation of PIC 66. Energetic material can be positioned along an inner surface of liner 62 as shown, and this serves to drive liner 62 as desired, generating a shaping or forming liner into one or more projectiles, potentially plastically-deforming metal, along an axis of trajectory from that subassembly. Primary liner 62 in this configuration is a conical shaped member, having a concave surface facing outward. Upon initiation, liner 62 is deformed into a jet of metal that can accomplish significant penetration into hard or armored plate materials such as are encountered in military settings and also in well casings. Of course, although liner 62 is shown in this configuration as conical shape, other shapes are possible, such as dish or saucer shape, or the like.

The additional subassemblies 70 have additional energetic material 74 that also is engaged around an inner surface of additional liner 72, and additional liner 72 in this configuration is also a conical shaped metallic member. As shown, however, additional energetic material 74 is also arranged in housing 52 to have a stem 82 that extends inwardly from away from additional liner 72. Stem 82 extends into the zone of the housing that is between the symmetrical pattern of primary subassemblies, specifically the zone of the housing that is between the primary energetic material of primary subassemblies. Stem 82 advantageously has an elongate shape, and a diameter that is sized to be within about 150 and 200% of the critical diameter of the energetic material in the stem. Stem 82 should also be configured sufficiently long for the initiation to self-center. Self-centering can be accomplished at a ratio of length to diameter of at least about 3:1.

Critical diameter is dependent upon the type of energetic material, suitable examples of which are discussed below. Critical diameter can be between about 1 mm and about 10 mm. In this regard, examples of specific energetic material and corresponding critical diameters include PBX-9404, with a critical diameter of 1 mm, and Octol 75/25 (cast), with a critical diameter of 6 mm.

When pressure waves from the primary energetic material travel through the housing, they reach this stem 82 of the additional energetic material, and the shape and sizing of stem 82 auto centers the jet formed by initiation of the additional energetic material as desired. In an alternative approach, detonation of the energetic material can be such that it is not along the liner centerline, but instead along the circumference of the charge so long as the detonation of the explosive results in the pre-designed collapse of the liner to achieve the desired effects. Thus, the configuration of primary energetic material and additional energetic material can be balanced in any desired manner to accomplish a desired collapse of the liner.

Figure 3A:
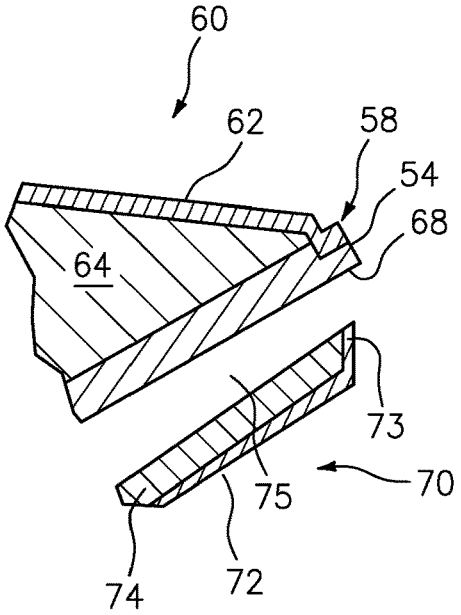
FIG. 3A is an enlarged portion of FIG. 3.

Referring also to FIG. 3A, an enlarged portion of FIG. 3 is shown, with additional detail of the structure of additional liner 72. As shown, additional liners 72 can have an outwardly radially extending lip 73. Lip 73 extends radially outwardly across the width of the additional energetic material 74 that surrounds liner 72. In addition, in the configuration shown in FIG. 3, a space 75 can be defined between additional energetic material 74 and the adjacent housing and primary subassembly 60. Space 75 provides a buffer or gap so that the detonation of primary subassemblies 60 do not damage the additional subassemblies 68 before the jet can form as desired. In this regard, the housing can have walls defining an area containing additional energetic material 74, or material 74 can be formed with sufficient structure to stay in place around liner 72.

In the disclosed configuration, stem 82 is a narrow extending body of energetic material that extends to a center point 83 of the portion 85 of energetic material that embraces the inner surface of additional liners 72. This is particularly effective at centering the initiation of the embracing portion 85, as the stem 82 directs initiation directly and only to center point 83, regardless of what portion of stem 82 is first encountered by pressure waves from initiation of adjacent primary energetic material (See also FIGS. 4-7 discussed below).

An explosive device as disclosed herein can utilize a significantly increased amount of surface area by deploying additional sympathetically initiated subassemblies in surface area that could not or would not have been occupied by primary subassemblies. Thus, the subassemblies of an explosive device as disclosed herein can include primary liners that cover between 50% and 80% of the outer surface, and additional liners that cover between 20% and 50% of the outer surface. It should be appreciated that there will still be some surface area that is not occupied by either primary or additional liners. Thus, these numbers will likely not add to 100%. Nevertheless, it should be appreciated that surface area that would have been left unused can now be used to increase the lethality of the explosive device as disclosed herein.

In the present disclosure, the housing can be fabricated using any known manufacturing process including, without limitation, additive manufacturing, injection or foundry molding, extrusion or the like. Housing can be made from any suitable material that meets the requirements for device stability during deployment, and that suitably transmits the internal pressure waves as discussed herein in order to sympathetically initiate the additional subassemblies. Examples of suitable material for the housing include but are not limited to aluminum, steel, titanium and combinations or alloys thereof.

Liners 62, 72 can be formed of any suitable material and in any suitable shape. Typically, for this type of ordnance, liners 62, 72 will have a concave outward shape, and will be made from a suitable metal that shapes or forms as desired when encountered by the detonation wave created by initiation of the energetic material. Examples of suitable material from which liners can be made include but are not limited to metals and ceramics such as copper, tantalum, aluminum, steel, ceramic, molybdenum, glass, and mixtures, combinations, composites or alloys thereof.

Energetic material 64, 74 can be the same or different materials, depending upon whether different properties are needed for the primary initiation and the sympathetic initiation. Non-limiting examples of suitable energetic material include but are not limited to polymer-bonded explosives such as PBXN-9, LX-14, PBXN-109, PBX-9404, Octol 75/25 and the like.

Further disclosure concerning the structure and operation of the precision initiation coupling 66 is well known to persons of ordinary skill in the art and is not provided herein.

Figure 7:
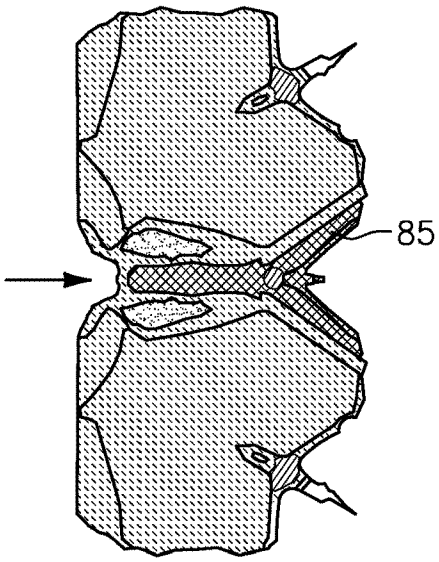
FIGS. 4-7 illustrate pressure waves generated by initiation of the primary energetic material in the configuration of FIG. 2.
Figure 6:
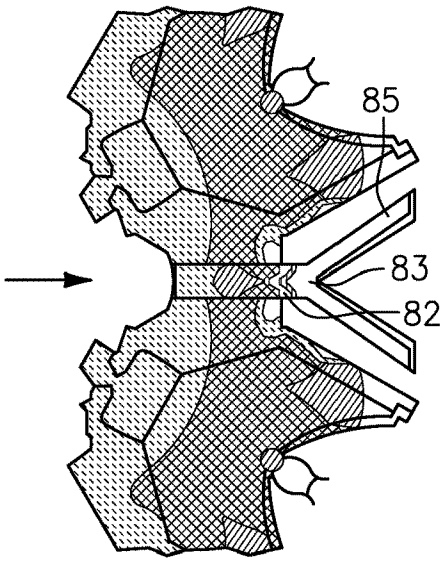
Figure 5:
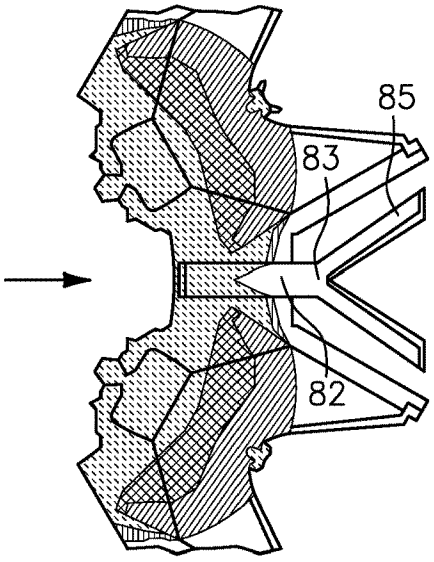
Figure 4:
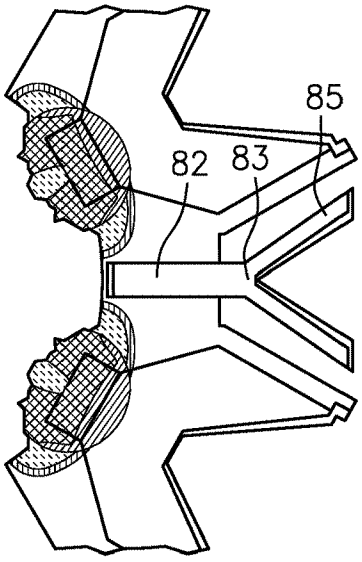

Turning now to FIGS. 4-7, a series of images are provided that illustrate travel of a pressure wave from the initiation of primary energetic material from its point of initiation in FIG. 4, to initial contact with stem 82 of additional energetic material 74 (FIG. 5), initiation of additional energetic material 74 (FIG. 6), and formation of a centered detonation wave and initial forming of liner 72 (FIG. 7). As set forth above, stem 82 positioned as shown with respect to the primary energetic material serves to center initiate the additional energetic material even if one or more of the primary subassemblies is not initiated synchronously. As previously mentioned, while configurations of the additional subassemblies 68 can advantageously include stem 82 to center the sympathetic initiation of the additional energetic material 74, such a stem is not required so long as the detonation of the explosive collapses the liner in the pre-designed fashion.

Figure 9:
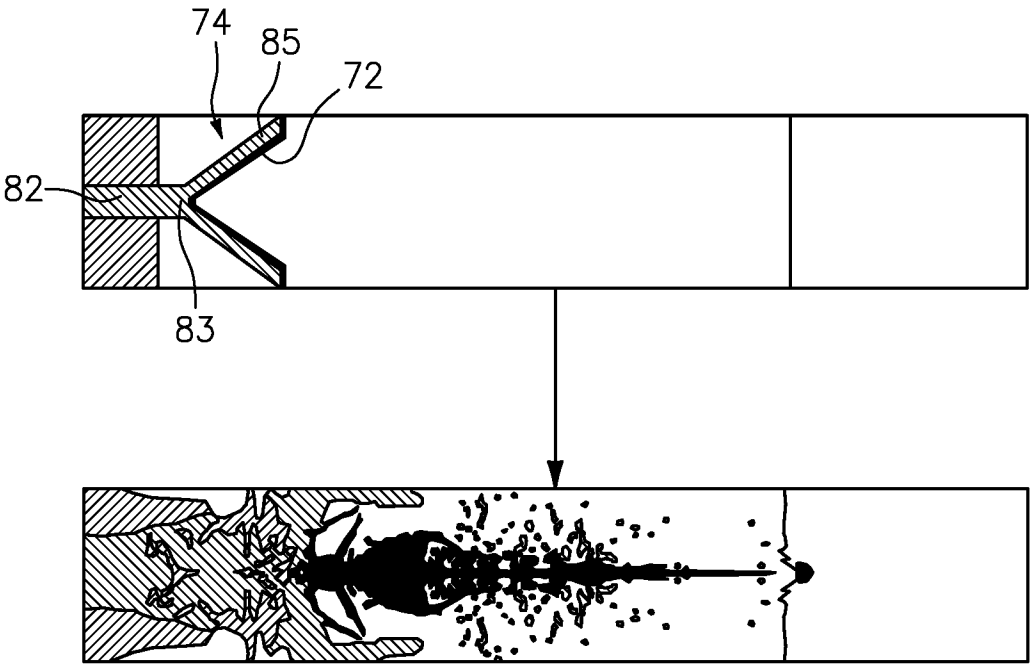
FIGS. 8-9 illustrate hydrocode modeling of a formed projectile and shaped charge jet generated by sympathetic detonation according to the disclosure.
Figure 8:
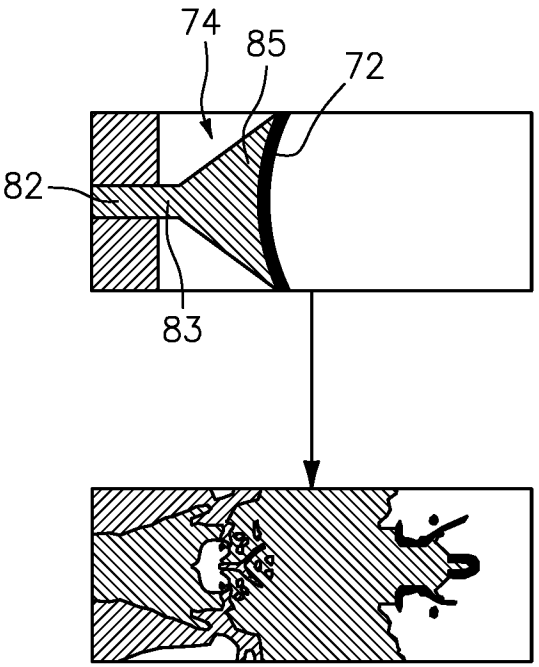

FIGS. 8 and 9 show the results of hydrocode modeling for two different configurations of additional subassemblies, confirming that an explosively formed projectile (FIG. 8) as well as a shaped charge jet (FIG. 9) can be generated by sympathetic initiation. Further, the geometry and shape of additional energetic material 74, including portion 85 and stem 82, results in center initiation and desirable performance.

In the above figures and modeling, it should be appreciated that the additional energetic material is positioned to be initiated only by initiation of the primary energetic material, and that the additional energetic material is positioned to be initiated only or at least substantially by pressure waves caused by initiation of the primary energetic material. This leads to the desired sympathetic initiation of the additional subassemblies as desired. Further, when the additional energetic material is initiated only by pressure waves caused by the primary energetic material, the additional subassemblies configured as disclosed herein will self center during initiation as desired.

It should be appreciated that an explosive device as disclosed herein, having a plurality of primary subassemblies initiated by a PIC, as well as an additional plurality of subassemblies that are sympathetically initiated, could find use in a military or ordnance setting, or for perforating a well casing, and likely in other settings that will become apparent to a person skilled in the art upon consideration of this disclosure. While the named applications are considered particularly advantageous, other applications are also considered to be within the scope of the disclosure and claims.

In connection with perforating a well casing, subterranean wells are frequently drilled to underground formations which, for example, can contain hydrocarbon or other liquid or flowable deposits that are desired to be obtained and brought to the surface. Such wells are constructed by drilling a hole through various rock formations, and deploying pipe or casing into the hole. The casing is typically cemented in place by pumping cement into an annular space between an outer wall of the casing, and an inner wall of the drilled hole. This cementing helps to secure the casing in the hole. However, at the location where the casing and well passes through the subterranean formation that contains the desired materials, flow must be created and facilitated from the area surrounding the well casing, into the casing where it can be produced or pumped or otherwise transported to the surface.

The explosive device is well suited to making these perforations, as the well controlled and high velocity projectiles that are created by initiation of the explosive device can readily penetrate the casing and cement, and the materials generated by initiation do not adversely impact the flowability for potentially viscous materials to enter the casing through the perforations made in the side wall of the well. Further, suitable ceramic or other materials can be selected that also do not adversely impact the permeability and other fluid bearing and flow characteristics of the formation around the well casing in the area of the perforations.

It should be appreciated that subterranean wells to be perforated can have a structure as discussed above, including casing and surrounding cement, or can have different structure depending upon the conditions traversed by the well. Thus, the use of the explosive device as disclosed herein is to perforate whatever structure us used to define the side wall of the well. While this will typically be a well casing and surrounding cement, use of the explosive device of this disclosure to perforate the side wall of a well extends to other situations where the side wall is defined by other structures or combinations of structures, for example casing without cement or with other consolidation material surrounding the casing, as non-limiting examples.

When the explosive device is to be used to perforate a side wall of a subterranean well, such a method begins by positioning an explosive device through a subterranean well defined be a well casing to a desired position in the well casing, wherein the explosive device comprises a housing having an outer surface and defining an inner space; a plurality of primary liners arranged on the outer surface in a spaced pattern and having primary energetic material inwardly positioned in the housing relative to the primary liners; an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material. Once the explosive device is at the depth or position in the well where perforation is desired, the primary energetic material is initiated. This leads to the additional energetic material being sympathetically initiated by the primary energetic material, and the primary liners and additional liners perforate the side wall. Because of the structure and configuration of the additional liners and additional energetic material, sympathetic initiation of the additional energetic material occurs in a self-centering manner such that the perforations formed by the additional liners are straight and oriented as desired, for example in a radially outwardly extending pattern.

Figure 10:
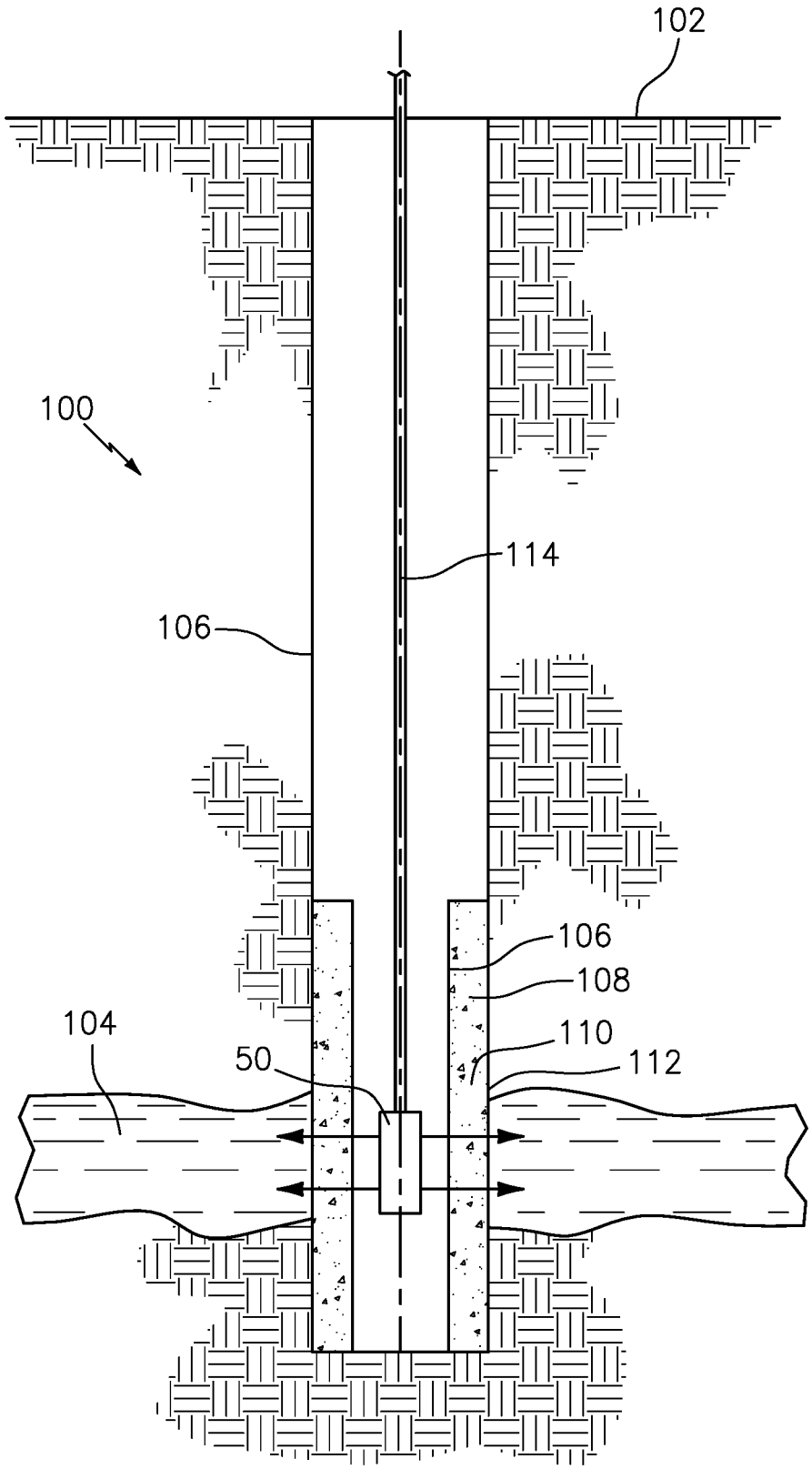
FIG. 10 illustrates a method for perforating a subterranean well using an explosive device as disclosed herein.

FIG. 10 schematically illustrates a well 100 extending from a surface level 102 to a subterranean formation 104. In this example, well 100 is defined by a side wall comprising a casing 106, and cement 108 is disposed around casing 106 in an annular space 110 defined between casing 106 and the wall 112 of the well bore. Casing 106, cement 108 and wall 112 of the well bore are collectively referred to herein as a side wall of the well, and an explosive device of the present disclosure is to be used to perforate this side wall.

FIG. 10 schematically illustrates explosive device 50 positioned through well 100 to the desired location at formation 104. A dashed line 114 represents a wire lead as one method for positioning device 50 to this location, but other methods can be utilized depending upon whether well 100 is substantially vertical or is a directional well. Once explosive device 50 is at the desired position, initiation can be started by activating the PIC device of the primary energetic material to trigger sympathetic initiation of the additional energetic material such that the primary and the additional subassemblies are deployed to penetrate the side wall of the well as desired.

One or more embodiments of the present disclosure have been described. Nevertheless, it will be understood that various modifications may be made without departing from the spirit and scope of the invention. For example, different materials and configurations could be utilized, and warheads having different shapes may benefit from this disclosure. Accordingly, other embodiments are within the scope of the following claims.

What is claimed is:

1. An explosive device comprising:

a housing having an outer surface and defining an inner space;

a plurality of primary liners arranged on the outer surface in a spaced pattern and having primary energetic material inwardly positioned in the housing relative to the primary liners;

an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material.

2. The explosive device of claim 1 wherein the housing is a cylindrical housing and the outer surface is an outwardly facing cylindrical surface of the cylindrical housing.

3. The explosive device of claim 1 wherein each additional liner is positioned between at least 2 primary liners, the at least 2 primary liners being positioned around the each additional liner.

4. The explosive device of claim 1 wherein each additional liner is positioned between 4 symmetrically positioned primary liners.

5. The explosive device of claim 1 wherein the additional energetic material of the additional liners extends inwardly in a stem positioned between the primary energetic material such that initiation of the primary energetic material forms a pressure wave that initiates the additional energetic material.

6. The explosive device of claim 5 wherein the stem has a diameter that is between 150% and 200% of the critical diameter of the stem.

7. The explosive device of claim 5 wherein the stem has a ratio of length to critical diameter of the stem of at least 3:1.

8. The explosive device of claim 1 wherein each primary liner of the plurality of primary liners has an outwardly convex shape, and wherein the primary energetic material surrounds an inner surface of the primary liner.

9. The explosive device of claim 8 wherein each additional liner of the plurality of additional liners has an outwardly convex shape, and wherein the additional energetic material surrounds an inner surface of the additional liner.

10. The explosive device of claim 1 wherein the plurality of primary liners and the plurality of additional liners comprise metallic liners, ceramic liners and combinations thereof.

11. The explosive device of claim 1 wherein the liners comprise at least one material selected from the group consisting of copper, tantalum, aluminum, steel, ceramic, molybdenum, glass, and mixtures, combinations, composites or alloys thereof.

12. The explosive device of claim 1 wherein the energetic material comprises a polymer-bonded explosive.

13. The explosive device of claim 1 wherein the housing has a plurality of openings, and wherein the primary liners and the additional liners are mounted in the openings.

14. The explosive device of claim 1 wherein the housing comprises a material selected from the group consisting of aluminum, steel, titanium and combinations or alloys thereof.

15. The explosive device of claim 1 wherein the primary liners cover between 50% and 80% of the outer surface, and wherein the additional liners cover between 20% and 50% of the outer surface.

16. The explosive device of claim 1 wherein the additional energetic material is positioned to be initiated only by initiation of the primary energetic material.

17. The explosive device of claim 1 wherein the additional energetic material is positioned to be initiated only by pressure waves caused by initiation of the primary energetic material.

18. The explosive device of claim 1 wherein the primary energetic material and the additional energetic material are configured within the housing such that initiation of the primary energetic material generates particles traveling at between 1 and 10 km/s.

19. A method for perforating a side wall of a subterranean well comprising the steps of:

positioning an explosive device through a subterranean well defined be a well casing to a desired position in the well casing, wherein the explosive device comprises a housing having an outer surface and defining an inner space; a plurality of primary liners arranged on the outer surface in a spaced pattern and having primary energetic material inwardly positioned in the housing relative to the primary liners; an initiation mechanism in the inner space for initiating the primary energetic material to drive the primary liners; and a plurality of additional liners positioned in the spaced pattern between the primary liners and having additional energetic material positioned in proximity to the primary energetic material such that the additional energetic material is sympathetically initiated by initiation of the primary energetic material;

initiating the primary energetic material wherein the additional energetic material is sympathetically initiated by the primary energetic material, and the primary liners and additional liners perforate the side wall.

* * * * *